United States Patent [19]

Spink

[11] 3,966,460

[45] June 29, 1976

[54] REDUCTION OF METAL HALIDES

[75] Inventor: Donald R. Spink, Waterloo, Canada

[73] Assignee: Amax Specialty Metal Corporation, Greenwich, Conn.

[22] Filed: Sept. 6, 1974

[21] Appl. No.: 503,723

[52] U.S. Cl. ..... 75/84.4; 75/84.5; 266/148; 266/166

[51] Int. Cl.[2] ..... C22B 34/14; C21C 7/00

[58] Field of Search ..... 75/84.4, 84.5; 266/34 R, 34 T, 34 V

[56] References Cited

UNITED STATES PATENTS

| | | | |
|---|---|---|---|
| 2,787,539 | 4/1957 | Conklin | 75/84.5 |
| 3,692,294 | 9/1972 | Ishimatsu | 266/34 R |
| 3,847,596 | 11/1974 | Holland | 75/84.4 |

*Primary Examiner*—Benjamin R. Padgett
*Assistant Examiner*—Donald P. Walsh

[57] ABSTRACT

A process for producing zirconium or hafnium metals by the reduction of their tetrachlorides with an excess of molten magnesium is provided with increased reactor capacity, increased yield per run, and improved economy by virtue of withdrawal of magnesium chloride as formed during the reaction, which permits subsequent separation and recovery of excess magnesium from the product by a simple distillation and in a form suitable for direct utilization in a second or subsequent reduction. Apparatus is provided which accommodates both the reduction process and the distillation in convenient fashion.

2 Claims, 2 Drawing Figures

REDUCTION OF METAL HALIDES

BACKGROUND OF THE INVENTION

In the production of zirconium and hafnium, the Kroll process chiefly concerns the reduction of the tetrahalides of zirconium or hafnium with magnesium to form zirconium or hafnium metal in accordance with the formula.

$$ACl_4 + 2\ Mg \rightarrow 2\ MgCl_2 + A$$

(wherein A represents zirconium or hafnium.)

The zirconium or hafnium sponge as provided by the Kroll process contains a substantial amount of excess magnesium, which is required in the reaction, and magnesium chloride by-product of the reaction. Relatively extensive purification procedures e.g. complex high temperature vacuum distillations and the like, are required to obtain the metal sponge product, free from magnesium chloride and magnesium, in pure form. As a serious factor in the economics of the process, the magnesium is not presently recovered in reusable or salable quality, and must be further processed, discarded or disposed of at distress prices.

Salt tapping has been practiced for many years in the Kroll reduction of titanium tetrachloride with magnesium. However, there are major differences between zirconium, for example and titanium, making salt tapping as conventionally practiced in the Kroll reduction of titanium inapplicable for zirconium. With titanium the salt taps are normally conducted intermittently, usually three or four taps per run, and bottom tapping is universal. Upon reduction, the titanium sponge forms in a dendritic manner, generally completely filling the reactor with a loosely defined mass of small crystals. When the magnesium chloride salt is drained away, the titanium sponge is exposed to the entering titanium tetracloride and probably reacts to form partially reduced forms ($TiCl_2$, $TiCl_3$) which subsequently pose no particular problem, indicating that conversion to a more stable form (Ti or $TiCl_4$) takes place during further processing.

Many attempts have been made to tap molten magnesium chloride during zirconium reduction, although techniques used for titanium could not be used with zirconium because metallic zirconium, being heavier than titanium settles compactly like a dense mud on the bottom of the crucible. Also it has been found that if any zirconium is exposed to the tetrachloride vapor, and some usually is when the magnesium salt is drained from the crucible, partially reduced forms of zirconium are produced. While such forms apparently are stable under conditions of reduction, and even survive the distillation operation, upon exposure to air after distillation such partially reduced forms of zirconium will spontaneously ignite and normally will set the entire batch of zirconium sponge on fire, posing an obvious problem.

SUMMARY OF THE INVENTION

It is accordingly an object of the present invention to provide a process for the production of zirconium and hafnium by reduction of their tetrahalides with excess magnesium wherein the excess magnesium is recovered in useful form.

It is a further object of the invention to provide a process for the production of hafnium and zirconium wherein reactor unit production is substantially increased.

A still further object is to provide attendant apparatus whereby the process of the present invention is accomplished most conveniently.

With this background, the present invention resides in a system for removal of the magnesium chloride by-product during reduction in a manner whereby little or no magnesium is lost during removal and the zirconium sponge is never exposed to the incoming tetrachloride vapor, being separated therefrom by the magnesium surface which remains constant and can be kept near the top of the reduction vessel thereby eliminating the partially reduced zirconium forms and enhancing the reaction of the entering tetrachloride vapor with the magnesium.

BRIEF DESCRIPTION OF THE DRAWING FIGURES

In the accompanying drawing which is schematic throughout,

DETAILED DESCRIPTION OF AN ILLUSTRATIVE EMBODIMENT

Figure 2:
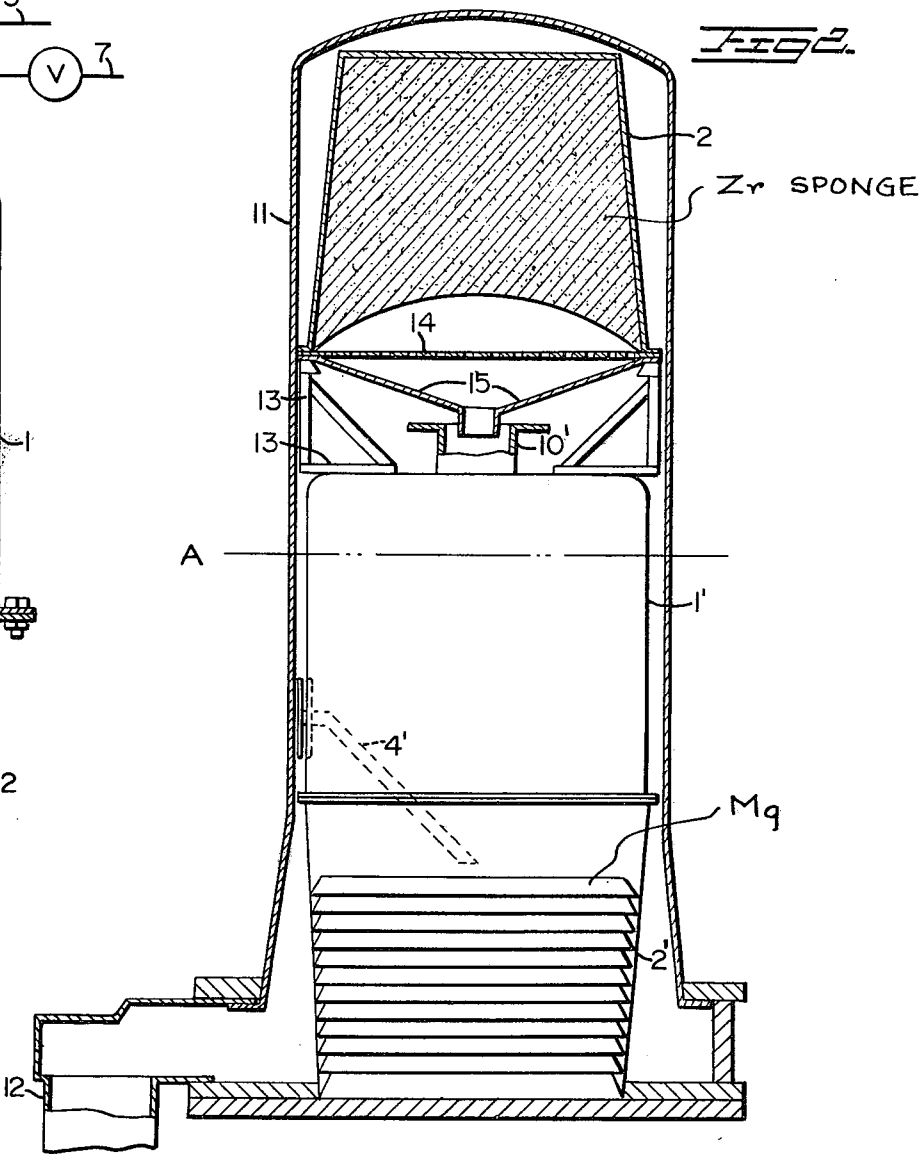
FIG. 2 represents, also in side elevation, a section through the distillation retort utilized in conjunction with the reduction furnace of FIG. 1 in carrying out the present invention.

The present invention can be most readily understood with reference to the drawing. In the operation of the reduction process, referring now to FIG. 1, there is provided a reduction reaction vessel 1, with a separable crucible portion 2 joined thereto by a suitable, pressure tight joint 3. The reduction reaction vessel can be fabricated from any suitable material to resist the temperatures and pressures required and to resist interaction with the materials with which it will be contacted in service. For economy and ease of fabrication, a mild steel plate on the order of about ¾ inches thick can be used, although certain alloys of steel, while more expensive, will better withstand the conditions of use. The physical dimensions can be adjusted to accommodate the quantities of zirconium or hafnium to be produced and the amount of magnesium required therefor. Within the limitations imposed by the cooperative interaction between the vessel and other apparatus, as hereinafter described, it is preferable to provide the largest diameter possible, since the reduction reaction rate is a function of cross-section area. As a further consideration, it is preferred to taper the crucible section 2 slightly to facilitate removal of the zirconium or hafnium sponge at the conclusion of the cycle.

Figure 1:
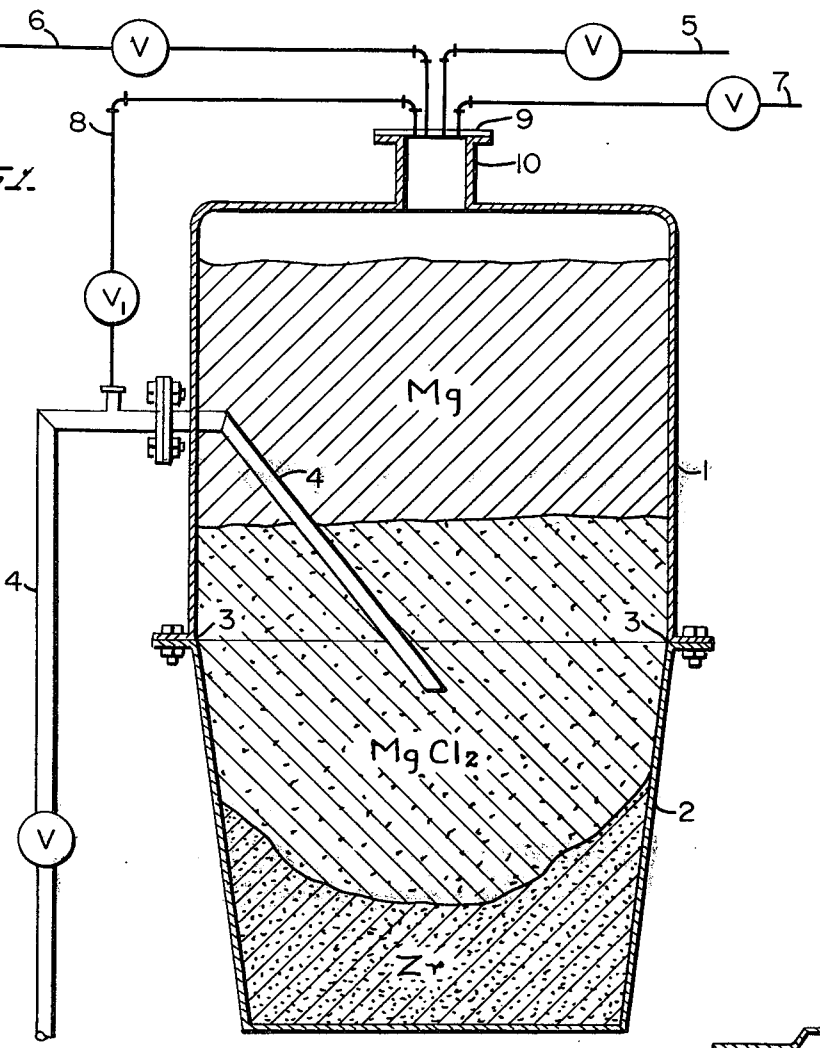
FIG. 1 represents, in side elevation and on an enlarged scale, a section of the reduction furnace of the present invention at an intermediate stage of the reduction process.

Extending into the reaction vessel from a point above the crucible portion 2 and joint 3, e.g. through the side wall of the upper portion of the reaction vessel, is salt tap pipe 4, which extends downwardly into the upper portion of the crucible 2 to a point which corresponds to the ultimate upper level of the zirconium or hafnium sponge to be deposited therein. The magnesium chloride by-product collects at the level immediately above the zirconium or hafnium sponge during the reaction, as shown in FIG. 1, and is withdrawn through the salt tap pipe 4.

Tap pipe 4 is, as seen in the drawing, jointed on the outside of the reactor so that the line can be disconnected during handling of the reaction vessel.

At the top of the reaction vessel 1, four lines 5, 6, 7 and 8, pass through cap 9 which is joined to neck 10 of the reaction vessel. Line 5 is provided for the introduction of zirconium tetrachloride or hafnium tetrachloride into the reaction vessel in the vapor phase, while line 6 introduces an inert gas, such as helium or argon. Line 7 is a pressure relief line and also serves to evacuate the reaction vessel when required. Line 8 is a pressure balancing line between salt tap pipe 4 and the top of the reactor.

Although not shown in the drawing, reaction vessel 1 is supplied with heating means, e.g. a furnace or the like, to provide necessary heat for the reaction. The heating means can comprise any convenient effective system and such are well known in the art.

With reference now to FIG. 2, a distillation retort apparatus utilized for the distillation of the excess magnesium and entrained magnesium chloride from the zirconium or hafnium metal sponge product is illustrated. Vacuum distillation retort 11 is adapted to receive the crucible section 2 from reduction reaction vessel 1, containing zirconium or hafnium metal sponge, the excess magnesium, and the entrained by-product $Mg\ Cl_2$, and also to receive a second reduction reaction vessel 1', with external fittings removed. Retort 11 is provided with vacuum line 12, and with heating means not shown for heating the top portion of the retort, above level A. The lower portion of the retort can be water cooled. The second reduction reaction vessel 1', wherein primed numbers indicate the features correspondingly numbered but unprimed in FIG. 1, is fitted into the bottom of retort 11, and full crucible 2 is disposed above it, as shown, inverted with the open portion facing downwardly. Crucible 2 is supported above reaction vessel 1' by support ring schematically indicated at 13. The zirconium or hafnium sponge is maintained in the crucible 2 by support plate 14, which can be a perforated plate or the like. Interposed between the mouth of crucible 2, and neck 10' of reaction vessel 1', is funnel 15, which serves to direct molten magnesium and magnesium chloride from crucible 2 into reaction vessel 1'.

In operation, the process of the present invention is conducted in the following fashion: The reduction reaction vessel 1 of FIG. 1 is loaded with the proper amount of magnesium and the reactor is evacuated via line 7, leak checked and backfilled with an inert gas introduced via line 6. The reaction vessel, now substantially devoid of oxygen and nitrogen, is heated to melt the magnesium and bring it to a temperature on the order of about 900°C. As the temperature increases, the gases in the reactor expand, necessitating venting the reactor. It is preferred to maintain the pressure at about 1 psig during heat-up period. Once the magnesium has been completely melted, the vessel may be partially evacuated prior to the introduction of Zr or Hf tetrachloride in the vapor phase. The reduction between the zirconium or hafnium tetrachloride and the molten magnesium takes place at the surface of the magnesium, and solid zirconium or hafnium particles formed during the reduction settle to the bottom of the crucible 2, while molten magnesium chloride by-product, being of greater density than magnesium, also settles below the molten magnesium but above the zirconium or hafnium sponge, where it is continuously drawn off via tap pipe 4 when the combined level of magnesium and magnesium chloride over the zirconium or hafnium layer at the bottom of the reactor is such that magnesium chloride will underflow out of tap pipe 4. Such underflow begins when the $Mg\ Cl_2$ level reaches the open end of pipe 4, and continues by gravity discharge until the end of the run. The open line 8 functions as a pressure balancing line to preclude siphoning. As the magnesium is consumed during the reaction, the level of $Mg\ Cl_2$ rises above the open end of pipe 4 to provide a combined level of Mg and $Mg\ Cl_2$ sufficient to maintain the gravity discharge of $Mg\ Cl_2$. The small particles of metallic zirconium or hafnium formed during the reduction step fall initially through a layer of molten magnesium which completely wets and therefore costs each particle which remains coated as it settles to the bottom of the crucible. Each particle also passes through a layer of magnesium chloride which wets the magnesium coating and is entrained with the zirconium or hafnium as it is formed.

The removal of the bulk of the magnesium chloride in this fashion during the reduction step serves to increase the reduction reaction vessel unit capacity by an amount corresponding to the volume of the magnesium chloride withdrawn. Removal of the magnesium chloride also facilitates separation of the excess magnesium from the zirconium or hafnium sponge product at the completion of reaction, and permits recovery of the magnesium in reusable form.

The rate of reaction is determined by the tetrachloride concentration in the reactor, the surface area of the magnesium and the temperature which is ordinarily maintained at about 800° to 900°C. Since the reaction is exothermic, reaction rates are best controlled by the reactor temperature and to a lesser extent by the concentration of tetrachloride vapor in the reactor.

A single run is completed when either the calculated amount of tetrachloride vapor has been introduced, or when the rate of reaction is such that the tetrachloride vapor rate must be adjusted back to between 50 and 100 lbs. per hour in order to maintain a reaction vessel pressure of about 1 psig, i.e. when the available supply of magnesium has been substantially used up.

At the completion of the run, it is preferred to shut off the flow of the tetrachloride and to maintain the vessel at a temperature of about 900°C for about 1 hour to allow any unreacted tetrachloride in the vessel to react with the magnesium. After this period, valve V, in the pressure equalizing line between salt tap pipe 4 and the top of the reactor is closed and argon pressure is applied via line 6 to the retort so as to effectively pressurize all the $Mg\ Cl_2$ out of the retort via the tapline. All $Mg\ Cl_2$ is removed when the pressure in the retort drops back to atmospheric pressure. The reaction vessel may then be removed from the furnace and cooled, after which the crucible 2 is removed for the high temperature distillation operation.

The cooled crucible 2, containing zirconium or hafnium sponge, some unreacted magnesium and some magnesium chloride, is transferred into the vacuum distillation retort 11 of FIG. 2. A second reduction reaction vessel 1' like vessel 1 but loaded with magnesium in an amount calculated to provide, with the excess magnesium to be recovered from crucible 2, all of the magnesium required for a subsequent reduction step as previously described and, with the exception of some external piping, ready for a reduction run, is placed in retort 11 to receive magnesium distilled from crucible 2. Once crucible 2 is in place, and retort 11 sealed and evacuated to below one torr, the retort is heated to a temperature at which the magnesium distills into the second reaction vessel. The load of magnesium in the second vessel 1′ acts as a heat sink which accelerates the distillation step. Once the distillation is complete the retort is cooled and the pressure re-established, at which point crucible 2 is withdrawn for the removal of the zirconium or hafnium product, while reactor 1′ is withdrawn, containing now all of the magnesium required for a second reduction. The second reactor 1′ is then ready to be placed on stream.

In its broadest terms, the present invention resides in the reduction of zirconium or hafnium tetrachloride with magnesium wherein magnesium chloride is removed as formed by undertapping once the level of magnesium chloride reaches the tap point, and wherein excess magnesium is recovered for subsequent utilization. Within this broad context, the process of the present invention provides greater economy of operation, minimizes handling, enhances capacity, provides more economical use of time per reduction unit, and improves the quality of the zirconium or hafnium products. The instant process significantly increases the amount of zirconium or hafnium sponge produced per run, per unit of time or per unit of equipment (e.g. up to 3 times the current production.) Also, it recovers the magnesium chloride by-product in a purity and form ideal for recycling to a suitable magnesium chloride cell, and indeed this by-product can be delivered in the molten state to an adjoining electrolytic cell. In addition, the process of this invention is capable of producing an exceptionally high quality of zirconium or hafnium metal because of the larger size batch of metal capable of being produced per run, the inherent reduction in the handling of extremely hydroscopic tetrachloride, elimination of the physical handling of the sponge in its undistilled state, and the vast reduction in the time of exposure of the reactants and products to ambient conditions.

While particular embodiments of the present invention are shown and described herein, it will be understood that the invention is subject to variation and modification without departing from its broader aspects. Accordingly, it is intended that the scope of the present invention be defined and limited only by the following appended claims.

I claim:

1. A process for the production of a metal selected from the group consisting of zirconium and hafnium from its tetrahalide comprising:

a. reducing the metal tetrahalide with a stoichiometric excess of magnesium in a inert atmosphere and at an elevated temperature in a first retort having an upper portion and a lower first crucible portion;
b. withdrawing magnesium halide from said first retort substantially as formed during the reaction while continuously maintaining a protection cover of magnesium chloride over the reduced metal;
c. the said reduced metal being deposited in the first crucible and containing excess magnesium and entrained magnesium chloride;
d. a reaction vessel having an upper portion and a lower portion;
e. removing said first crucible from the first retort and placing it inverted in the upper portion of said reaction vessel;
f. inserting in the lower portion of the reaction vessel a second retort having an upper portion and a lower second crucible portion;
g. heating the upper portion of the reaction vessel and vacuum distilling off the excess magnesium and entrained magnesium halide from the reduced metal in the first crucible;
h. maintaining the lower portion of the reaction vessel at a lower temperature to condense the vapors of magnesium and magnesium chloride;
i. passing the magnesium and magnesium chloride into the second retort from the first crucible; and
j. employing said second retort in a subsequent reduction of said metal halides as in step (a) above.

2. The method of claim 1 wherein said second retort contains a quantity of magnesium to provide a heat sink to accelerate the distillation and to provide together with the recovered excess magnesium sufficient magnesium necessary for the subsequent reduction of the metal halides.

* * * * *

UNITED STATES PATENT AND TRADEMARK OFFICE

CERTIFICATE OF CORRECTION

PATENT NO. : 3,966,460

DATED : June 29, 1976

INVENTOR(S) : Donald R. Spink

It is certified that error appears in the above-identified patent and that said Letters Patent are hereby corrected as shown below:

Assignee: "Amax Specialty Metal Corporation" should be --Amax Specialty Metals Corporation--

Signed and Sealed this

Second Day of November 1976

[SEAL]

*Attest:*

RUTH C. MASON
*Attesting Officer*

C. MARSHALL DANN
*Commissioner of Patents and Trademarks*